United States Patent [19]

Reuter

[11] Patent Number: 5,011,423

[45] Date of Patent: Apr. 30, 1991

[54] PLUGGING DEVICE FOR THE ELECTRIC INITIATION OF AN AIRBAG PROVIDED WITH LOCKING MEANS TO PERMIT THE OPENING THEREOF WITHOUT TRIGGERING THE FUNCTIONING OF THE AIRBAG

[75] Inventor: Werner Reuter, Erkrath, Fed. Rep. of Germany

[73] Assignee: Grote & Hartmann GmbH & Co. KG, Wuppertal, Fed. Rep. of Germany

[21] Appl. No.: 427,874

[22] Filed: Oct. 30, 1989

[30] Foreign Application Priority Data

Nov. 4, 1988 [DE] Fed. Rep. of Germany ... 8813830[U]

[51] Int. Cl.[5] ..... H01R 13/703

[52] U.S. Cl. ..... 439/341; 439/188

[58] Field of Search ..... 439/188, 341; 200/51.1, 200/51.09, 51.07

[56] References Cited

U.S. PATENT DOCUMENTS

| | | | |
|---|---|---|---|
| 1,834,184 | 12/1931 | Schramm | 200/51.1 |
| 3,869,191 | 3/1975 | Tolnar Jr. | 439/345 |
| 4,438,303 | 3/1984 | Astier | 200/51.1 |

FOREIGN PATENT DOCUMENTS

| | | |
|---|---|---|
| 715152 | 12/1941 | Fed. Rep. of Germany . |
| 2131171 | 1/1973 | Fed. Rep. of Germany . |
| 2354795 | 5/1975 | Fed. Rep. of Germany . |

*Primary Examiner*—Neil Abrams

*Attorney, Agent, or Firm*—Goodman & Teitelbaum

[57] ABSTRACT

A plugging device for connecting at least one line of an electric switching arrangement for the electrical initiation of an airbag, including two plugging device parts with contact elements for the line, and an auxiliary switching arrangement including two auxiliary contacts in association with a short circuit bridge arrangement to prevent the initiation of the airbag when the plugging device is opened. During the opening movement of the plugging device, first the two auxiliary contact are closed to close the short circuit bridge arrangement to bring about a shirt circuit to prevent the initiation of the airbag, after which the contact elements are opened. The plugging device includes a delay opening mechanism for retarding the opening movement of the plugging device between the closing of the two auxiliary contacts and the opening of the contact elements to allow a longer time to bring about the short circuit. The delay opening mechanism includes a releasable locking mechanism to lock the plugging device in a closed position, the locking mechanism including an elastically bendable grip part having a first portion to lock the plugging device in the closed position and a second stop portion to maintain the plugging device in an open position between the closing of the two auxiliary contacts and the opening of the contact elements at the end of a first movement stage during the opening movement. Thereafter, the second stop portion is released to start a second movement stage so that the plugging device can be fully opened.

15 Claims, 3 Drawing Sheets

PLUGGING DEVICE FOR THE ELECTRIC INITIATION OF AN AIRBAG PROVIDED WITH LOCKING MEANS TO PERMIT THE OPENING THEREOF WITHOUT TRIGGERING THE FUNCTIONING OF THE AIRBAG

Airbags are located for the protection of occupants of a vehicle in such places, for example in the stearing wheel or in the rear of a motor vehicle in which, in case of an impact accident, injuries to the occupants are threaten. In case of an impact accident the airbag is to be very rapidly unfolded and inflated. For the initiation of these mechanical processes an electric switching system is provided, which reacts to certain commands.

It is necessary from time to time--for example for maintenance purposes, to check the switching system without triggering the functioning of the airbag. For this, according to the testing, it is also necessary to open the plugging device. In order to prevent the functioning of the airbag from being triggered on opening of the plugging device, the applicant, in a copending application Ser. No. 427,872 filed Oct. 30, 1989, has proposed an electric switching arrangement as auxiliary switching arrangement in which there is provided a short circuit bridge arranged in one of the two plugging device parts in each case between contacts belonging to one another, which bridge enters into functioning on opening of the plugging device. The short circuit bridge has a spring arm shank which with open plugging device, by reason of its spring tension lies on the appertaining contact and also brings about the short circuit and with closed plugging device is misplaced or bent out by a separating pusher mounted on the other plugging device part against its spring force into a readiness position. To avoid reiterations, reference is made to this copending application Ser. No. 427,872 in its full scope.

In a plugging device of the type indicated at the outset, a wrong contact triggering the functioning of the airbag is not to be excluded especially if the plugging device is rapidly opened. There the possibility of a wrong contact or the undesired triggering of the functioning of the airbag increases with increase of the opening speed. In the previously described formation, even at normal opening speed it is possible to reckon with a wrong contact triggering, in which context it is to be taken into consideration that by contact difficulties due, for example, to oxidation, the response speed of the auxiliary contact can lag and hereby bring about an unintended wrong contact. Of importance in the previously described short circuit arrangement is not only the length of the path which the spring arm shank requires between its readiness position and its contact position with the appertaining contact element, but also the speed at which the spring arm shank moves.

Underlying the invention is the problem, in a plugging device of the present type, of improving the function security especially of the auxiliary switching arrangement.

This problem is solved by the features set forth below.

In the formation according to the invention the delaying mechanism on opening of the plugging device leads to a delaying of the opening movement between the closing and opening points of the contact elements and the closing and opening points, respectively, of the auxiliary contacts. By reason of this delaying of the opening movement there is available to the auxiliary contacts a substantially longer time to execute the appertaining contact and thus to activate the auxiliary switching arrangement for the purpose of preventing the initiation of the airbag. There it can be a matter with the contact elements and auxiliary contacts, of the contacts being active through opening and/or closing.

Advantageous further formations of the invention which improve the functioning security, make possible a simple and convenient handling and lead to a simple and economically producible as well as small construction, are described below.

In the following the invention is explained in detail in a preferred embodiment represented in the drawings in which.

Figure 1:
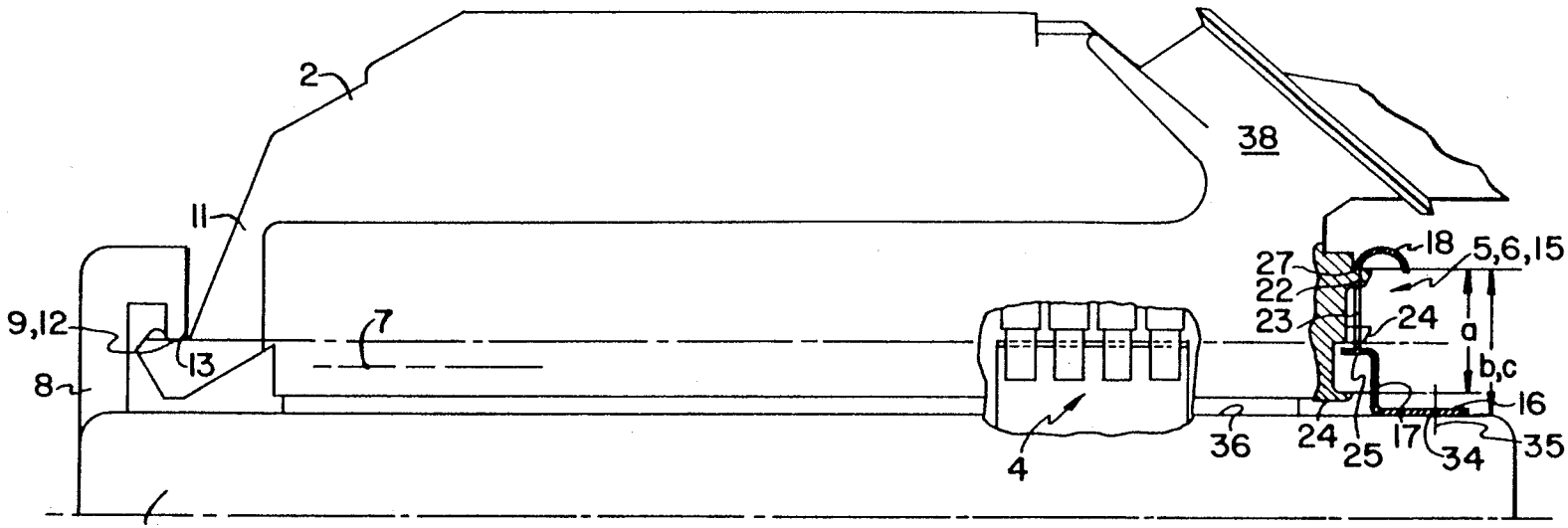
FIG. 1 shows a plugging device according to the invention, partly sectioned, for connecting at least one line of an electric switching arrangement for the electric initiation of an airbag in side view and in its closed position.

The main parts of the plugging device designated generally with 1 are two plugging device parts (not represented in detail), which are received in casing parts 2, 3, contact element pairs and an auxiliary contact pair, of which, for reasons of simplication, only one type of contact elements 4 : is shown for the connecting of lines of an electric switching arrangement for the electrical initiation of the airbag (not represented),and a closure or locking mechanism 5 for the casing parts 2, 3, in which a delay mechanism is integrated for the delaying of the opening movement of the casing part 2 held hingeably on the casing part 3. The casing part 3 is held in a manner not represented on a part of the vehicle chassis present or formed thereon.

For the hingable support of the removable casing part 2 there serves a counter-bearing 8 bent inward in C-shape, projecting from one end of the held casing part 3 above the separation joint 7, with a resting place 9 on its curved downward free end. The resting place is gripped below by an end-side projection 11 of the removable casing part 2 and is slightly gripped behind, since the projection 11 presents a small, rounded bearing trough 12 which, on engagement of the casing parts 2, 3 on one another as shown in FIG. 1, lies on the likewise rounded resting place 9 of the counter-bearing 8. By lifting the removable casing part 2 after opening of the locking mechanism 5, therefore, the casing of the plugging device 1 can be opened at will, and by pivoting the case part 2 downward about the swinging axis 13 at the rest place 9, closed again. In the present invention the removable casing part 2 presents a casing cover.

In each casing part 2, 3 there is arranged the appertaining plugging device part (not represented, and held or fixed in a manner not represented), of which the plugging device part arranged in the removable casing part 2 carries the contact elements 4 constructed alike among one another and arranged in the same manner. In the pivoting upward of the casing part 2, accordingly, the contact elements 4 with the unrepresented counter-contact elements are removed, which are arranged on the unrepresented plugging device part of the held casing part 3. By the pivoting upward of the casing part 2, therefore, the plugging device is opened, and by the pivoting downward it is closed again as shown in FIG. 1.

In the present invention, as set forth in the above referred to copending application Ser. No. 427,872, the contact elements 4 have spring arms lying opposite one another, between which in the closing position in each case there is grasped a counter-contact element in the form of a pin, this pin presses apart the spring arm pair against its spring force. In this manner a secure contact is assured.

The aforementioned auxiliary contact pair (not represented) is formed in the present invention by a contact member movably held in one of the two plugging device parts and a control member proceeding from the other plugging device part, the arrangement being made in such a way that the control member, with the plugging device 1 closed displaces the contact member out of its contact position with a counter-contact member in the same plugging device part. Preferably an auxiliary switching arrangement connectable with the contact member by its contacting is formed by a short circuit bridge arrangement with a short circuit bridge, which is capable in each case of short-circuiting with one another two contact elements 4 belonging to one another. There it is advantageous to construct the contact member as part of the short circuit bridge and the appertaining contact element 4 as a counter-contact member, so that with the plugging device 1 closed, the control member holds the short circuit bridge out of contact with the appertaining contact elements 4 and thereby prevents the short circuit. There the arrangement is made in such a way that on opening of the plugging device 1 first the contact member and the control member pass out of contact and thereby the short circuit bridge brings about the short circuit of the contact elements 4 concerned before the contact elements 4 and the appertaining counter-contact elements are opened, i.e. separated from one another. In the present invention the contact member is arranged in the plugging device part held by the removable casing part 2, while the control member in the form of a separating pusher proceeds from the plugging device part which is arranged in the held casing part 3. In a preferred embodiment such as is described and represented in the above referred to copending application Ser. No. 427,872, the contact member is formed by a laterally bent out spring arm shank of a U-shaped short circuit bridge and the control member interacts with an oblique bent portion of the spring arm shank, so that in the closing and opening of the plugging device 1 the spring arm shank is displaced or freed from its contact position with a part of the appertaining contact element 4, so that by reason of its spring tension, the spring arm shank it presses against the contact element 4 and thereby brings about the short circuit. For reasons of simplification the auxiliary switching arrangement with the short circuit bridge arrangement is not represented, and reference is made to the above referred to copending application Ser. No. 427,872, to which reference is made in its full scope.

Figure 2:
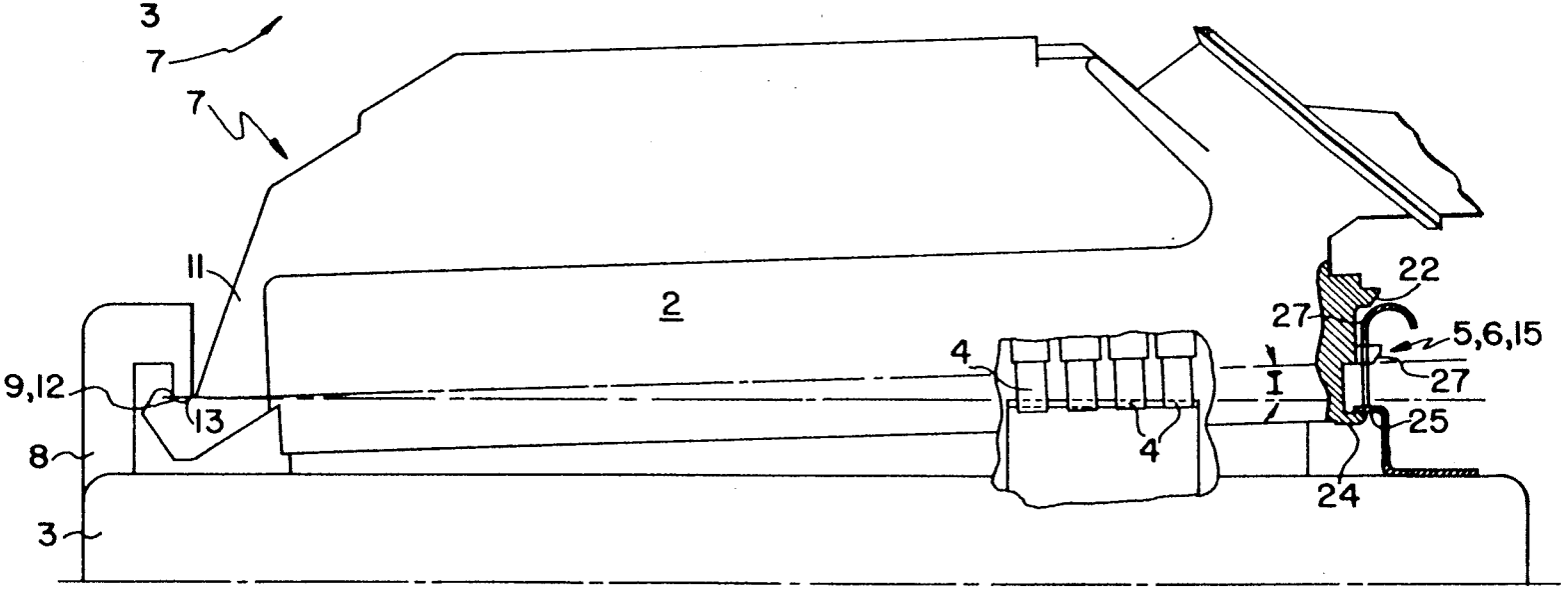
FIG. 2 shows the plugging device in its opening in a first opening stage.
Figure 5:
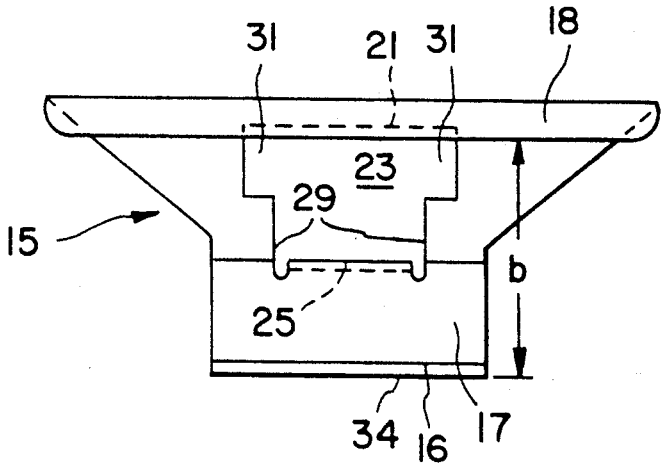
FIG. 5 shows an essential functioning element of the delay mechanism in a view corresponding to FIG. 3.

The locking mechanism 5 is arranged on the face side of the casing lying opposite the counter-bearing 8. The locking mechanism 5 or the delay mechanism 6 integrated therein includes a grip part 15 in an angular form having a shank 16, rectangular in plan view, extending substantially parallel to the separation and a second shank 17 extending substantially at a right angle to the shank 16, on the free end of the second shank 17 there is arranged a preferably roundly bent grip edge 18. The locking of the removable casing part 2 in the closed position occurs through a locking edge 21 of the grip part 15 which grips over a projection 22 extending from the face side of the casing part 2. The locking edge 21 is formed by the upper boundary edge of a T-shaped cutout 23 in the second shank 17 of the grip part 15, as best shown in FIG. 5, so that in the locking position of the projection 22 the locking edge 21 is grippingly positioned on the projection 22 which extends into the cutout or opening 23. Underneath the projection 22 there is provided at a distance a a second projection 24 extending forward from the face side of the casing part 2, which cooperates with a correspondingly bent off stop strip 25 on the second shank 17, the stop strip 25 bounding the opening movement of the casing part 2 at the end of the first opening stage I, as shown in FIG. 2.

Figure 3:
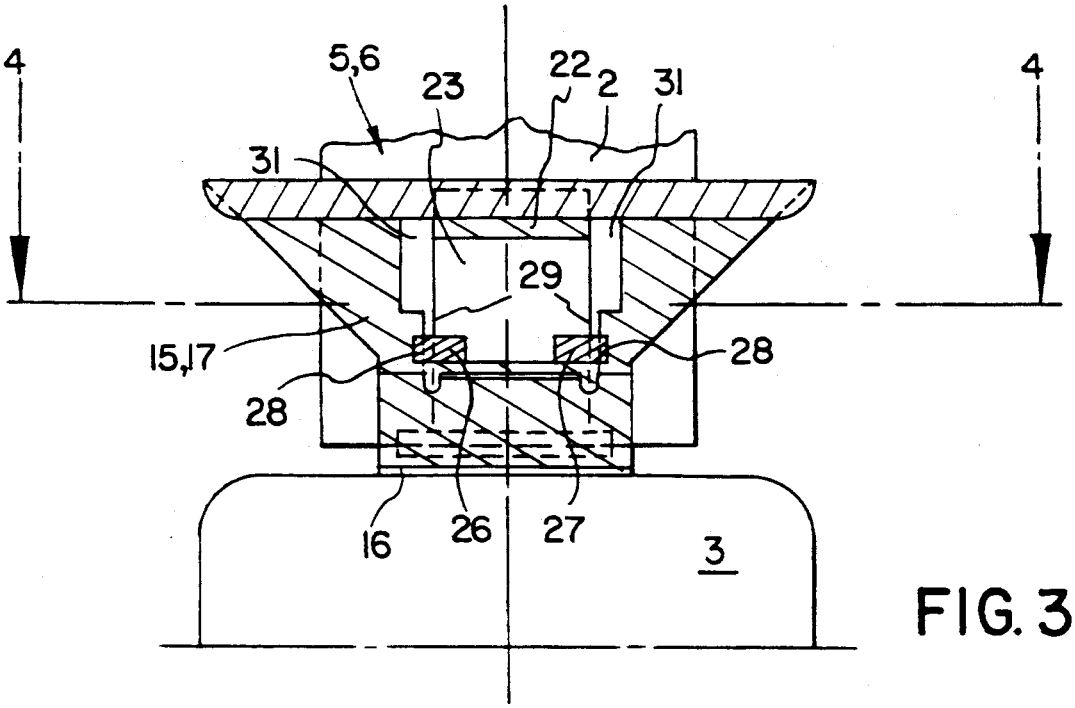
FIG. 3 shows a delay mechanism for the opening movement of the plugging device as enlarged detail in the side view from the right.
Figure 4:
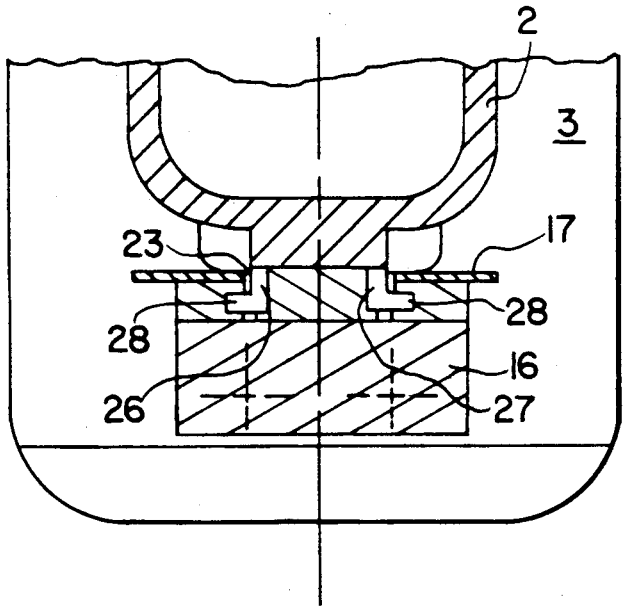
FIG. 4 shows the section IV—IV in FIG. 3.
Figure 6:
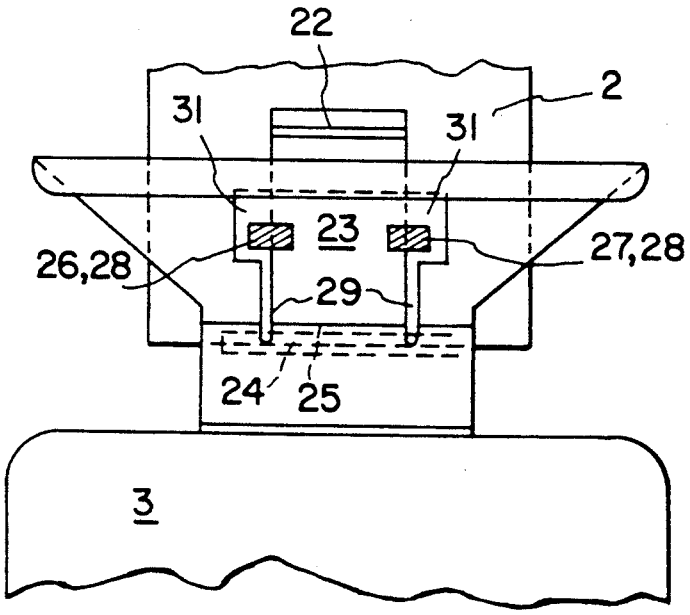
FIG. 6 shows a view corresponding to FIG. 3 of the delay mechanism with plugging device present at the end of the first opening stage.

Between the first and the second projection 22, 24 there are arranged two third projections 26, 27, spaced from one another, and extending from the casing part 2, which in the normal position of the grip part 15 grip through the opening 23 and with lateral holding lugs 28 grip in front of the lateral edges 29 of the opening 23, as shown in FIGS. 3 and 4. In the upper portion of the opening 23 there are provided on both sides the T-beam cutouts or undercuttings 31, which are dimensioned in such a way that at the end of the first opening stage I of the casing part 2 the third projections 26, 27 can be introduced into the upper portion of the opening 23, as shown in FIG. 6. The insertion and extraction of the third projections 26, 27 occurs through lateral bending of the grip part 15, which in the present embodiment consists of spring steel, especially leaf spring steel and is a stamped part.

For the locking of the removable casing part 2 the third projections 26, 27 in the first opening stage I (FIG. 6) are introduced into the undercuttings 31 of the opening 23 by bending down and then back again of the second shank 17, in which process, by underside bevels of the projections 22, 24, 26, 27, the introduction is facilitated and the second shank 17 can be automatically bent out. When the projections 26, 27 grip through the lower portion of the opening 23 the casing part 2 is hinged shut, with the holding lugs 28 gripping behind the side edges 29 of the opening 23 and the locking edge 21 passing into a position gripping over the projection 22 as shown in FIGS. 1, 3 and 4.

For the opening of the plugging device 1 the second shank 17 is bent out laterally away from the casing part 2 by manual engagement on the grip edge 18, in which process the second shank 17 bends out only in that portion thereof positioned above the holding lugs 28, because the holding lugs 28 hold onto the second shank 17 laterally. As soon as the locking edge 21 frees the first projection 22, the casing part 2 can be opened, until the opening movement is stopped at the end of the first opening stage I by impact of the second projection 24 on the stop strip 25. By this limitation of the opening movement, a retardation of the opening movement is forcibly brought about by the stop strip 25. A continued opening movement to open the casing part 2 further apart from the casing part 3 can occur only after a the holding lugs 28 are free of the edges 29, as shown in FIG. 6, and when the second shank 17 of the grip part 15 is again bent out laterally away from the casing part 2 to free the second projection 24. In this further bending-out of the shank 17, the projection 24 comes out of contact with the stop strip 25, so that the casing part 2 can be further pivoted upward or swung and, if need be, the casing part 2 can be displaced from the support place 9 and thus be fully removed from the casing part 3.

The arrangement is made in such a way that at the end of the first opening stage I the contact between the contact member and the control member is already interrupted, i.e. in the present invention the short circuit bridge has already gone into operation for the purpose of bringing about the short circuit, while the contact between the contact elements 4 and the appertaining counter-contact elements still stands. Through the retardation of the opening movement, accordingly, the auxiliary switching arrangement, in this case the short circuit bridge arrangement, is made available for an increased time to prevent the triggering of the airbag, which would then take place if the contact elements 4 should be opened before the short circuit bridge arrangement is closed into its operational position to bring about the short circuit. The possibility of such a wrong switching is present when the removable casing part 2 is opened at a high opening speed. By reason of the formation according to the invention a wrong switching is avoided, because the delay assures a safe triggering of the auxiliary switching arrangement preventing the initiation of the airbag.

It is advantageous to make the distance b between the locking edge 21 and the fastening side 34 of the first shank 16 fastened by screws or rivets to the fastening surface 36 of the held casing part 3 somewhat less than the distance c between the locking receptacle formed by the projection 22 and the fastening surface 36, as shown in FIGS. 1 and 5. Hereby the casing part 2 is pressed by a certain tension against the casing part 3, which tension is yielded from the forced bending-out of the first shank 16 from the second shank 17.

With 38 there is designated a connecting piece on the removable casing part 2 for the lead-through of electric lines. In the present invention the second shank 17 has a Z-shaped bend-out at 39, which prevents and arching of the shank 17 in the bending out laterally of the shank 17 for the first opening stage.

Within the scope of the invention it is also possible to realize a stop preventing the opening movement of the casing part 2 by impact of the third projections 26, 27 at the locking edge 21 or special stop edges. In such a case the projection 24 and the stop 25 can be omitted.

In order to facilitate the handling and also to increase the strength, in the present invention the shank 17 is widened about from its middle to its free end in the manner of a mushroom head or conically, which is clearly to be perceived from FIGS. 3, 5 and 6.

The casing parts 2, 3 consist of metal, especially of an aluminum or zinc alloy or plastic and are preferably injection molded parts.

I claim:

1. In a plugging device for connecting at least one line of an electric switching arrangement for electrical initiation of an airbag, including first and second plugging device parts having contact elements for the line, and an auxiliary switching arrangement having first and second auxiliary contacts to prevent the initiation of the airbag when the plugging device is opened, the auxiliary switching arrangement including a short circuit bridge arrangement associated with the first and second auxiliary contacts so that when the first and second auxiliary contacts are closed in engagement with each other during opening movement of the plugging device, the short circuit bridge arrangement is also closed to bring about a short circuit to prevent the initiation of the airbag, the first auxiliary contact being movably held in the first plugging device part and the second auxiliary contact being immovably held in the second plugging device part, the first and second auxiliary contacts being closed at a predetermined first position during the opening movement of the plugging device, the contact elements being opened out of engagement with each other at a predetermined second position during the opening movement of the plugging device, the predetermined first position for closing the first and second auxiliary contacts being reached first during the opening movement of the plugging device before the predetermined second position for opening the contact elements so that the short circuit occurs to prevent the initiation of the airbag, an improvement comprising:

said plugging device including first and second casing parts with the first plugging device part being disposed in said first casing part, and the second plugging device part being disposed in said second casing part;

hinge means for connecting one end of said first casing part to one end of said second casing part so that said first casing part can pivot away from said second casing part during the opening movement of said plugging device;

delay opening means for retarding the pivoting of said first casing part during the opening movement of said plugging device at a predetermined third position disposed between said predetermined first and second position to allow a longer time to bring about the short circuit;

said delay opening means including a locking mechanism arranged at a distance from said hinge means on opposite ends of said first and second casing parts;

said locking mechanism including a grip part secured on the opposite end of said second casing part so that said grip part can be bent elastically away from the opposite end of said first casing part for first and second movement stages during the opening movement of said plugging device;

said grip part including locking means for engaging the opposite end of said first casing part to lock said first and second casing parts together in a closed position;

said grip part including stop means for engaging the opposite end of said first casing part to maintain said first casing part at said predetermined third position at an end of said first movement stage during the opening movement of said plugging device; and said first casing part including holding means for engaging said grip part during said first movement stage so that said stop means is prevented from being pulled away from said first casing part when said grip part is bent elastically away from the opposite end of said first casing part to a first releasing position to open said plugging device;

whereby at the end of said first movement stage, said grip part is again bent elastically away from the opposite end of said first casing part to a second releasing position to release said stop means to start said second movement stage so that said plugging device can be fully opened.

2. A plugging device according to claim 1, wherein said third predetermined position is located at said first predetermined position so that said first and second auxiliary contacts are closed at the end of said first movement stage.

3. A plugging device according to claim 1, wherein said holding means includes two adjacent holding members projection outwardly from said opposite end of said first casing part for engaging said grip part.

4. A plugging device according to claim 1, wherein said grip part includes an angularly formed shank extending upwardly from said second casing part toward said first casing part to be along the opening movement, said shank including said locking means and said stop means.

5. A plugging device according to claim 1, wherein said grip part is fabricated from elastic synthetic material.

6. A plugging device according to claim 1, wherein said grip part is fabricated from spring steel.

7. A plugging device according to claim 1, wherein said grip part is a stamped part.

8. A plugging device according to claim 1, wherein said stop means is a bent shoulder formed on said grip part.

9. A plugging device according to claim 1, wherein said locking means engages a first projection molded on said opposite end of said first casing part, and said stop means engages a spaced apart second projection molded on said opposite end of said first casing part.

10. A plugging device according to claim 1, wherein an opening is provided in said grip part, said locking means being an upper edge of said grip part opening extending transversely to the opening movement.

11. A plugging device according to claim 10, wherein said holding means includes at least one holding lug extending through said grip part opening and gripping a side edge of said grip part opening extending in a direction the opening movement, an upper portion of said grip part opening being enlarged to freely receive said holding lug at the end of said first movement stage.

12. A plugging device according to claim 10, wherein a lower edge of said grip part opening extending transversely to the opening movement is angled-off to provide said stop means.

13. A plugging device according to claim 23, wherein a free upper end of said grip part is angled-off to provide a grip edge.

14. A plugging device according to claim 1, wherein a locking edge of said locking means engages an upper surface of a projection extending from said first casing part, a fastening side of said grip part being secured to a fastening surface of said second casing part, a first distance between said locking edge and said fastening side of said grip part being slightly less than a second distance between said projection upper surface and said fastening surface of said second casing part in said closed position.

15. A plugging device according to claim 1, wherein said grip part includes a base first shank secured to said second casing part and a second shank extending upwardly from said first shank toward said first casing part, said second shank including said stop means extending into a lower portion of said second shank, said stop means and said lower portion of said second shank together with said first shank providing a Z-shaped configuration with respect to said first casing part lying opposite said grip part.

* * * * *